US006289663B1

(12) United States Patent
Schroder

(10) Patent No.: US 6,289,663 B1
(45) Date of Patent: Sep. 18, 2001

(54) CONDUIT PLATE ADAPTER FOR AN OPEN-END ROTOR SPINNING MACHINE

(75) Inventor: Hans-Josef Schroder, Mönchengladbach (DE)

(73) Assignee: W. Schlafhorst AG & Co., Monchengladbach (DE)

( * ) Notice: Subject to any disclaimer, the term of this patent is extended or adjusted under 35 U.S.C. 154(b) by 0 days.

(21) Appl. No.: 09/467,337

(22) Filed: Dec. 20, 1999

(30) Foreign Application Priority Data

Dec. 21, 1998 (DE) ..... 198 59 164

(51) Int. Cl.[7] ..... D01H 4/08
(52) U.S. Cl. ..... 57/406
(58) Field of Search ..... 57/406, 408, 411, 57/413, 414, 415, 417, 404, 400

(56) References Cited

U.S. PATENT DOCUMENTS

| | | | | |
|---|---|---|---|---|
| 4,854,119 | * | 8/1989 | Stahlecker et al. | 57/406 |
| 5,280,700 | * | 1/1994 | Haase et al. | 57/406 |
| 5,768,881 | * | 6/1998 | Lauschke | 57/414 |
| 5,778,654 | | 7/1998 | Stahlecker | 57/413 |
| 5,937,630 | | 8/1999 | Wassenhoven | 57/407 |
| 5,953,896 | * | 9/1999 | Stahlecker | 57/408 |
| 5,953,897 | | 9/1999 | Wassehoven et al. | 57/413 |

FOREIGN PATENT DOCUMENTS

| | | |
|---|---|---|
| 39 15 813 A1 | 11/1990 | (DE) . |
| 43 34 485 A1 | 4/1995 | (DE) . |
| 195 24 837 A1 | 1/1997 | (DE) . |
| 195 44 617 A1 | 6/1997 | (DE) . |
| 198 36 073 | 8/1998 | (DE) . |
| 197 12 881 A1 | 10/1998 | (DE) . |

OTHER PUBLICATIONS

German Search Report.
Abstract for DE3915813.

* cited by examiner

*Primary Examiner*—Danny Worrell
(74) *Attorney, Agent, or Firm*—Kennedy Covington Lobdell & Hickman LLP

(57) ABSTRACT

A conduit plate adapter (10) for an open-end spinning device (1) which device comprises a vacuum-loadable rotor housing (2) which can be sealed by a cover element (5) and which device comprises a spinning rotor (3) rotating at high speed in the rotor housing (2). The replaceable conduit plate adapter (10) is arranged in a receptacle (7) of the cover element (5) and comprises, as is customary, the mouth area (32) of a fiber guide conduit (12) as well as a yarn withdrawal nozzle (11). The fiber guide conduit section running inside the conduit plate adapter (10) has an entrance opening (28) with a non-circular cross section in the area of the conical contact surface (19) of the conduit plate adapter (10).

4 Claims, 3 Drawing Sheets

CONDUIT PLATE ADAPTER FOR AN OPEN-END ROTOR SPINNING MACHINE

CROSS-REFERENCE TO RELATED APPLICATIONS

This application claims the benefit of German Application DE 19859164, filed Dec. 21, 1998, herein incorporated by reference.

FIELD OF THE INVENTION

The present invention relates to a conduit plate adapter for an open-end rotor spinning device wherein the open-end spinning device includes a vacuum-loadable rotor housing with a rotating spinning rotor.

BACKGROUND OF THE INVENTION

Open-end rotor spinning devices of the above-indicated type typically comprise a cover element which seals a rotor housing during the spinning process by means of a lip seal in an airtight manner. The rotor housing is open to the front. The cover element comprises a bearing bracket for mounting an opening cylinder as well as bearing brackets for a swivel pin which are arranged orthogonally to the axis of the opening cylinder. A conduit plate adapter, which can be readily replaced, if necessary, is fitted into the cover element. The cover element is connected via this swivel pin to an associated spinning-box housing. Moreover, the opening-cylinder housing of a sliver opening device as well as the bearing housing of a sliver feeding cylinder are fixed on the cover element.

The individual fibers combed out of a feed sliver by the opening cylinder are transported via a so-called fiber guide conduit to the spinning rotor and spun by the spinning rotor into a yarn which can be continuously drawn off. As is known, for example, from German Patent Disclosure DE 197 12 881 A1, the opening-cylinder housing is connected to a receptacle in the cover element for the conduit plate adapter via a fiber guide conduit assembly which is formed in conduit sections. The fiber guide conduit assembly consists in its totality of two separate conduit sections, namely, a conduit section formed inside an insert portion of the fiber guide conduit assembly and another conduit section arranged in the particular conduit plate adapter.

When the engaged cover element is pivoted closed during the operation, the conduit plate adapter extends into the rotating rotor. It is assured in this manner that the mouth area of the fiber guide conduit is positioned sufficiently close to the fiber guide wall of the spinning rotor so that the individual fibers transported in the fiber guide conduit are fed onto the spinning rotor as prescribed. The conduit plate adapter also comprises a bore for fixing a yarn withdrawal nozzle adjacent to the mouth area of the fiber guide conduit.

The conduit plate adapter is coordinated for a certain rotor diameter. Thus, if, for example, it is necessary to replace the spinning rotor during the course of a change of a yarn batch, the conduit plate adapter must be replaced at the same time.

Open-end rotor spinning devices with such replaceably arranged conduit plate adapters are basically known and described, for example, in German Patent Disclosure DE 43 34 485 A1. In the spinning device of German Patent Disclosure DE 43 34 485 A1, the pivotably mounted cover element comprises an annular groove for inserting a lip seal element and a receptacle with conical contact surfaces which is open in the direction of the rotor housing. A conduit plate adapter is detachably fixed in this receptacle by means of screw bolts which extend through corresponding bores in the cover element and engage in fastening bores of the conduit plate adapter.

However, this type of fastening is disadvantageous in this known device since two machine screws must be removed in order to replace the conduit plate adapter, which is relatively time-consuming.

A similar open-end rotor spinning device is described in German Patent Disclosure DE 195 24 837 A1. However, the cover element in this device comprises a conduit plate adapter which is secured by a bar spring in the receptacle of the cover element. The conduit plate adapter can be rapidly and smoothly dismounted as needed by bending back the bar spring. In order to secure the conduit plate adapter, the bar spring fastened on one end to the fiber conduit plate engages in a tangential groove formed into the conical contact surface of the bearing body of the conduit plate adapter.

However, in practice, such a fastening method is only conditionally suitable for assuring a reliable seal of the conduit plate adapter which can be readily detached if necessary. An off-center introduction of force of the securing means can result, for example, in a tilting of the conical bearing body of the conduit plate adapter in the receptacle of the cover element with the consequence that problems with false air flowing can occur at the spinning devices.

German Patent Disclosure DE 198 36 073 describes an open-end rotor spinning device in which the detachable fastening of the conduit plate adapter on the cover element takes place in a non-positive manner via a magnetic coupling. That is, disk-shaped permanent magnets are introduced into the receptacle of the cover element which magnets correspond to a ferromagnetic component of the conduit plate adapter, preferably a steel disk.

This purely non-positive fixing of a conduit plate adapter in the receptacle of the cover element results in a simple fixing of the conduit plate adapter which can be readily and rapidly detached in case of need but is very reliable and exact during operation. However, in practice, the conduit plate adapter still needs improvement, especially in the area of the entrance of the fiber guide conduit.

SUMMARY OF THE INVENTION

It is accordingly an object of the present invention to create a conduit plate adapter of the type described above which is optimized, in particular, regarding the shaping of its fiber guide conduit section and overcomes the aforementioned disadvantages.

The present invention addresses this objective by providing an improved fiber guide conduit section in a conical conduit plate adapter adapted to be attached to a receptacle of a cover element of an open-end spinning device having a vacuum-loadable rotor housing with a rotating spinning rotor. According to the present invention, the conduit plate adapter basically comprises a section of a fiber guide conduit for transporting fibers into the spinning rotor from an entrance opening of a non-circular cross section in the area of the conical surface of the conduit plate adapter to a fiber exit mouth. A replaceable yarn withdrawal nozzle is also fitted into the conduit plate adapted for withdrawing a yarn from the spinning rotor.

Advantageous embodiments of the invention are set forth in more detail herein.

The design of the conduit plate adapter, especially of the fiber guide conduit section, assures an optimal flow course inside the fiber guide conduit so that the individual fibers transported in this airflow are fed onto the guide surface of the spinning rotor aligned in stretched fashion to a very great extent. In particular, the exact adaptation of the entrance opening, which lies in the range of the conical contact surface, of the fiber guide conduit section running inside the conduit plate adapter to the inside cross section of the adjacent conduit end area of the conduit running in the section of the fiber guide conduit, has a positive effect on the spinning results.

In a preferred embodiment, the ratio of height to width of the entrance opening of the fiber guide conduit section arranged in the conduit plate adapter is between about 1:1.3 and about 1:1.4. That is, the fiber guide conduit is somewhat wider than it is high in the area of its entrance opening. The wider extents of the fiber guide conduit initially extend conically toward one another following the entrance opening and then form a cylindrical conduit section up to the mouth of the fiber guide conduit. Such a design results, in combination with the features described above, in a fiber guide conduit with advantageous flow without the disadvantageous or damaging hindrances of flow.

Further details of the invention can be gathered from a non-limiting exemplary embodiment presented in the following description with reference made to the drawings.

DESCRIPTION OF THE PREFERRED EMBODIMENTS

Figure 1:
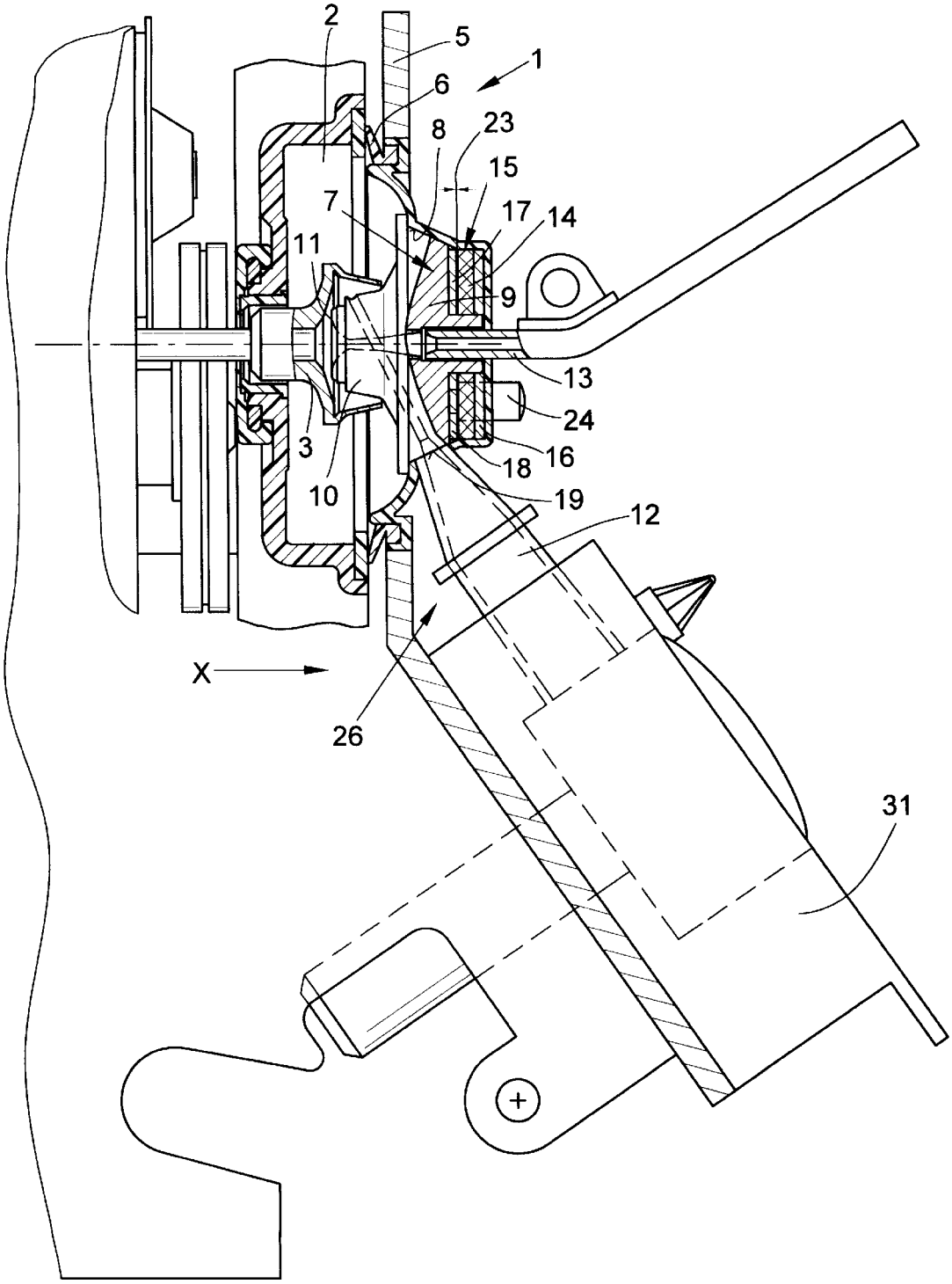
FIG. 1 is a partial view of an open-end spinning device with a spinning rotor rotating in a rotor housing as well as with a cover element for sealing the rotor housing; a conduit plate adapter is supported in the cover element in such a manner that it can be readily replaced.

The open-end spinning device 1 shown in FIG. 1 comprises rotor housing 2 which can be vacuum-loaded and in which spinning rotor 3 rotates at a high speed. Rotor housing 2, which is open to the front, is sealed airtight during operation by cover element 5 in the form of a fiber conduit plate. To this end, annular lip sealing element 6 is fitted or otherwise affixed into cover element 5. Lip sealing element 6 surrounds receptacle 7 open in the direction of rotor housing 2. Lateral contact surface 8 of such receptacle 7 is designed in the form of a cone.

Conduit plate adapter 10 with its bearing body 9 is fixed in receptacle 7 in such a manner than it can be aligned in an angularly precise manner and readily detached. The fastening takes place, for example, by means of magnetic coupling 15. Conduit plate adapter 10 comprises, as is customary, a central bore for yarn withdrawal nozzle 11 and mouth area 32 of fiber guide conduit 12. Yarn withdrawal tube 13 is arranged end to end with yarn withdrawal nozzle 11 in the direction of yarn draw-off.

Conduit plate adapter 10 comprises connection means 17 on its side opposite yarn withdrawal nozzle 11. Connection means 17 is preferably designed as ferromagnetic, annular steel disk 18, which is permanently connected to conduit plate adapter 10, manufactured, for example, of aluminum or plastic.

In the mounted state, conduit plate adapter 10 rests by its conical contact surface 19 on the correspondingly designed contact surface 8 of receptacle 7 and is fixed there, for example, by two disk-shaped permanent magnet inserts 14, 14'. Ejector 24, fastened, for example, on side 18 and extending partially outward through an opening of cover element 5 makes it possible to detach conduit plate adapter 10 in a simple manner out of receptacle 7 of cover element 5.

The angularly precise mounted position of conduit plate adapter 10 is assured by positioning device 20 comprising, for example, centering pin 21 fixed on conduit plate adapter 10 and comprising centering bore 22 introduced into bearing disk 16.

Figure 2:
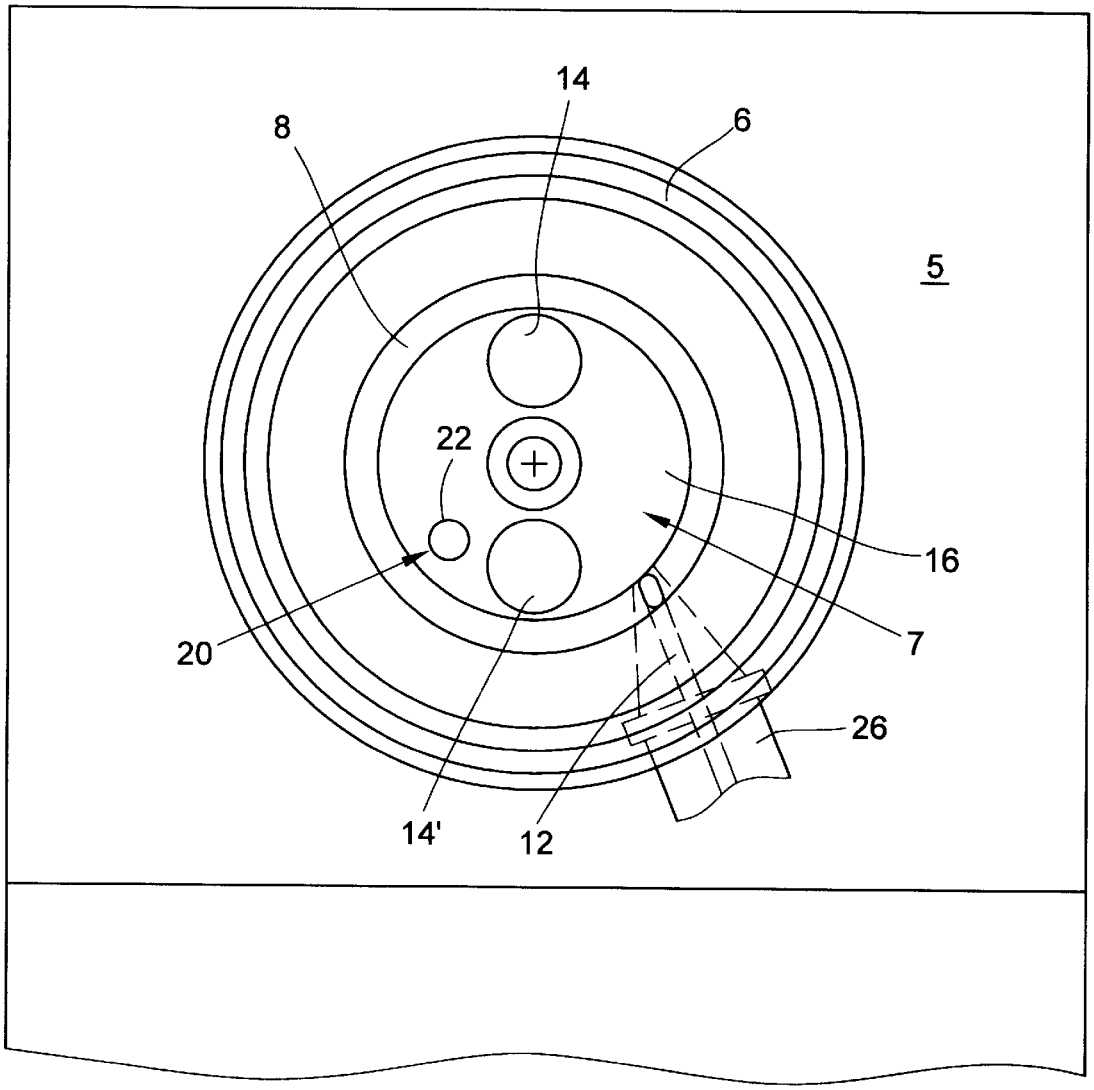
FIG. 2 is a view of the cover element along arrow X in FIG. 1.

As has already been mentioned previously and can be seen from FIG. 2, two permanent magnets 14, 14' are symmetrically arranged at the bottom of receptacle 7 and permanently anchored on cover element 5 via bearing disk 16. Bearing disk 16 forms a type of yoke thereby which contributes to strengthening the magnetic action by bundling the magnetic field lines. The associated ferromagnetic component, steel disk 18, is positioned in conduit plate adapter 10 in such a manner that permanent magnets 14, 14' and the ferromagnetic component stand opposite each other in the mounted state with preservation of a slight air gap 23. Air gap 23 is 0.1 mm to 0.2 mm, so that it is assured, on the one hand, that conduit plate adapter 10 always rests with contact surface 19 of its bearing body 9 on corresponding contact surface 8 of receptacle 7 of fiber conduit plate 5 and, on the other hand, a magnetic force is in effect which is sufficiently large to hold conduit plate adapter 10 reliably in this mounted position during operation as well as during the opening and closing of cover element 5.

Figure 3:
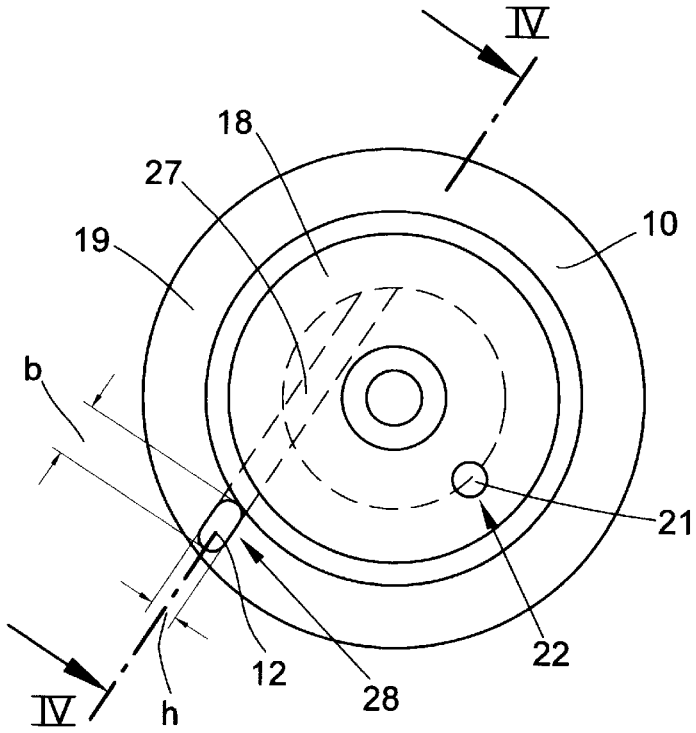
FIG. 3 is a rear view of a conduit plate adapter in accordance with the present invention.
Figure 4:
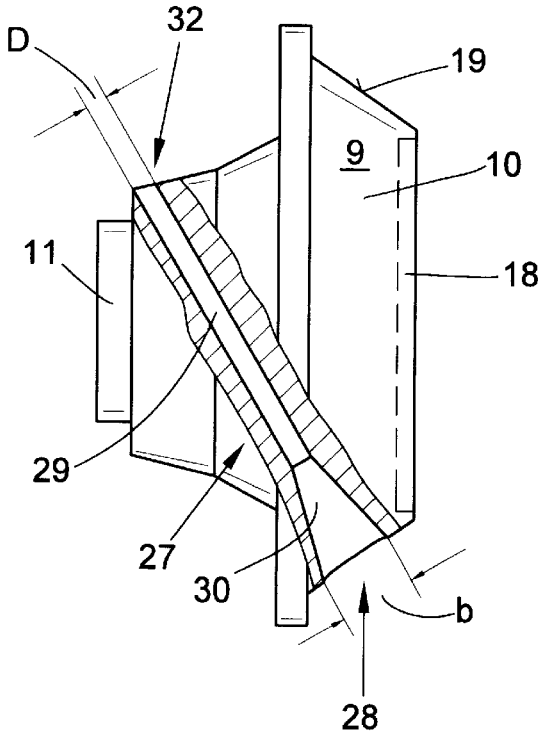
FIG. 4 is a lateral view in partial section of the conduit plate adapter according to FIG. 3.

Conduit plate adapter 10, shown in FIG. 3 and in FIG. 4, comprises fiber guide conduit section 27 of a fiber guide conduit characterized in its totality by reference numeral 12.

The individual fibers loosened by an opening cylinder out of a feed sliver are fed into the spinning rotor via this fiber guide conduit 12. Fiber guide conduit 12, which runs over a large part of its length inside fiber guide conduit insert 26, is designed in such a manner that the flow of transport air prevailing in the conduit assures a very extensively elongated transport of the individual fibers. That is, fiber guide conduit 12 has a height h which remains the same from the entrance of the fiber guide conduit in opening cylinder housing 31 to its mouth 32 in the area of conduit plate adapter 10 whereas the width b of fiber guide conduit 12 decreases toward its mouth 32.

Since fiber guide conduit 12 always consists of a "stationary" conduit section running in fiber guide conduit insert 26 and of an "ambulant" conduit section 27 arranged in replaceable conduit plate adapter 10, there is a critical intersection between these conduit sections.

In order to assure an unobjectionable transition, entrance opening 28 of conduit section 27 running in conduit plate adapter 10 is exactly adapted to the inside end cross section of the conduit section arranged in fiber guide conduit insert 26. That is, entrance opening 28 has a non-circular inside cross section with a height to width ratio between about 1:1.3 and about 1:1.4.

Conduit section 27 arranged inside conduit plate adapter 10 tapers regarding its width at its entrance and, whereat it is still somewhat conically (conduit stretch section 30), in order to subsequently form a fiber elongating section 29 up to mouth 32 of the fiber guide conduit which section 29 has a cylindrical inside cross section. The diameter D of this cylindrical conduit section 29 corresponds to height h of the fiber guide conduit in its conically designed stretch section 30.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A conduit plate adapter attachable to a receptacle of a cover element of an open-end spinning device having a vacuum-loadable rotor housing containing a rotating spinning rotor, the conduit plate adapter comprising:

a) a conical contact surface for receipt within the receptacle of the cover element, b) a section of a fiber guide conduit for transporting individual fibers into the spinning rotor from a fiber entrance opening having a non-circular cross-section in the area of the conical contact surface to a fiber exit mouth, and c) a replaceable yarn withdrawal nozzle for withdrawing a yarn from the spinning rotor.

2. The conduit plate adapter according to claim 1, wherein the fiber entrance opening of the fiber guide conduit has a height-to-width ratio between about 1:1.3 and about 1:1.4.

3. The conduit plate adapter according to claim 1, wherein the section of the fiber guide conduit in the conduit plate adapter includes a conical portion and a cylindrical portion.

4. The conduit plate adapter according to claim 3, wherein a diameter of the cylindrical portion of the conduit section corresponds to a height of the conical portion of the conduit section.

* * * * *